United States Patent [19]

Gray, deceased et al.

[11] 4,279,308

[45] Jul. 21, 1981

[54] SURFACE CASING STABILIZER AND HANGER AND METHOD OF EMPLOYING THE SAME

[76] Inventors: Charles E. Gray, deceased, late of Jena, La.; by Emma Dee Gray, executrix, Jena, La. 71342

[21] Appl. No.: 33,082

[22] Filed: Apr. 25, 1979

[51] Int. Cl.[3] ..... E21B 17/00

[52] U.S. Cl. ..... 166/315; 285/141; 285/144

[58] Field of Search ..... 166/93, 96, 215; 285/144, 141

[56] References Cited

U.S. PATENT DOCUMENTS

| | | | |
|---|---|---|---|
| 1,533,362 | 4/1925 | Babin | 285/144 X |
| 1,849,216 | 3/1932 | Adair | 285/144 X |
| 3,266,823 | 8/1966 | Word et al. | 285/144 |

*Primary Examiner*—William F. Pate, III

*Attorney, Agent, or Firm*—Sughrue, Mion, Zinn, Macpeak and Seas

[57] ABSTRACT

A two part, sectioned tapered cylindrical hanger and stabilizer threaded on its inner periphery which threads are broken circumferentially by longitudinally extending slots defining right angle edges which frictionally grip an enclosed metal well surface casing section. The cylindrical hanger sections are further slotted on their outer periphery longitudinally to facilitate lodging of the hanger in the casing conductor to fixedly locate the upper end of the surface well casing within the conductor in concentric relation therewith. The surface well casing extends the length of the hole, and during the installation procedure, concrete is forced downwardly through the center of the casing and caused to rise between the casing and the wall of the bore hole to lock the lower end of the surface casing to the bore hole. The vertical edges of the semi-circular hanger sections abut and are locked together by locking bars fitting within opposing recesses within the upper ends of the semi-annular hanger sections. T-bar handles threaded to the sections facilitate their transport and mounting to the upper end of the casing conducter.

5 Claims, 6 Drawing Figures

FIG. 1
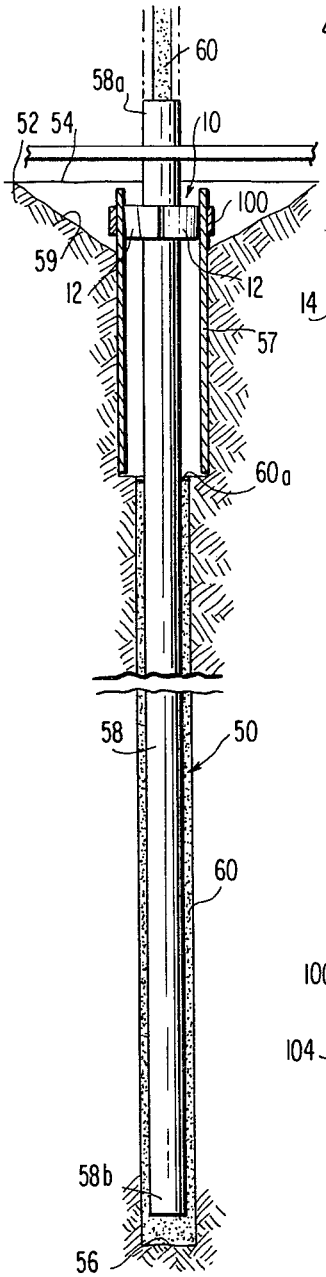
FIG. 2
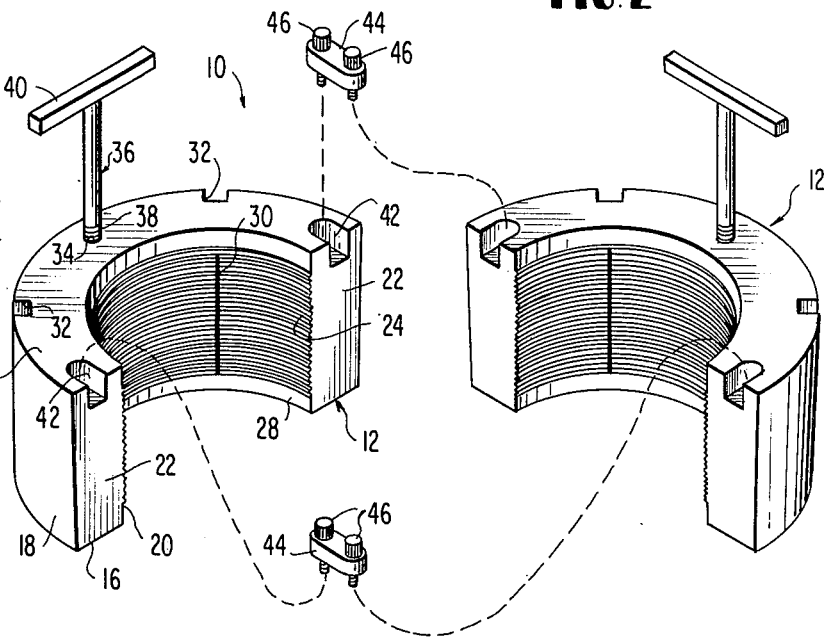
FIG. 3
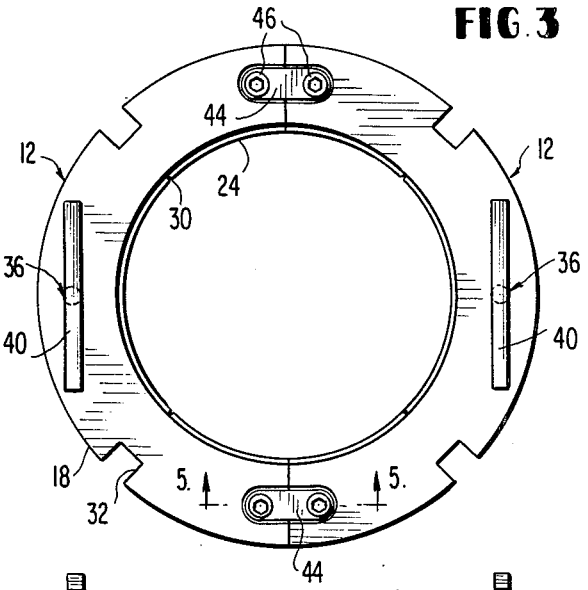
FIG. 6
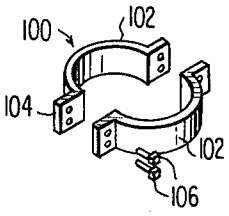
FIG. 4
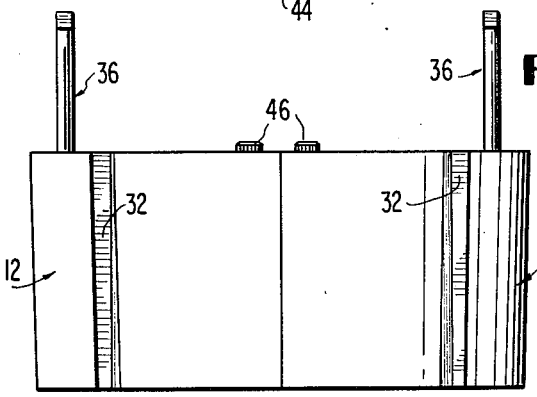
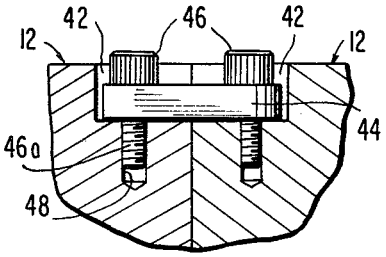
FIG. 5

SURFACE CASING STABILIZER AND HANGER AND METHOD OF EMPLOYING THE SAME

FIELD OF THE INVENTION

This invention relates to the fixing of a tubular metal oil and gas well surface casing or pipe within a previously installed casing conducter, and more particularly, to the utilization of a well casing hanger for fixedly mounting the upper end of the well casing concentrically within the conductor, with the casing extending into a bore hole extending through the conductor and into the earth therebelow. The hanger or stabilizer is installed either subsequent or prior to forcing of concrete to flow downwardly through the well casing to lock the well casing at its lower end through solidification of the concrete between the exterior of the well casing and the periphery of the bore hole.

BACKGROUND OF THE INVENTION

Prior to drilling of an oil or gas well bore hole to a desired depth it is necessary to initially drill an entry bore hole and to install surface casing in that bore hole, to protect the surrounding water table, and for other environmental reasons. This must be accomplished before drilling the well to the depth of the earth formation bearing the oil or gas. In this procedure, a tubular conductor pipe is first driven into the earth, and the entry bore hole is drilled after installation of the conductor pipe. Thereafter, it is necessary to remove the drilling equipment and to insert within the drilled entry bore hole, linked tubular metal pipe or well casing which extends from the ground level to the extent of the bore hole and to fixedly locate the well casing in that hole concentric with the conductor pipe. Conventionally, concrete is forced under pressure from the upper end of the well casing after it is inserted in the hole, through the well casing where it flows upwardly between the well casing and the periphery of the bore hole. After solidification of the concrete, the mass of the well casing is fixedly located with respect to that bore hole and drilling procedures to the depth of the oil or gas can proceed. Normally, the level of concrete between the exterior of the well casing and the periphery or wall of the bore hole does not reach the ground level but extends from the bottom of the bore hole vertically upwards for a sufficient distance to maintain the well casing within the earth formation regardless of pressures tending to force it upwardly. While in most cases the concrete is capable of fixing the well casing within the bore hole, there is difficulty in insuring that the well casing is fixed concentric with the conductor pipe, that is, coaxial therewith. Moreover, under conventional procedures, other activities on the drilling platform must await setting of the concrete, and during that time, lateral displacement of the casing can cause accidents and danger to the casing or other equipment. The apparatus of this invention is designed to set in the conductor pipe adjacent ground level in the bottom of an area called the cellar to hang the weight of the surface casings. This results in stabilization of the surface casing relative to the conductor pipe and to adjacent equipment.

The present invention is directed to insuring that the well casing is maintained in proper vertical alignment during setting of the concrete.

It is a further object of the present invention to provide an improved method of fixing a well casing concentrically within its conductor and for maintaining the concentric disposition of the well casing with respect to the bore hole and conductor during solidification of the concrete.

SUMMARY OF THE INVENTION

The invention in part is directed to a well casing hanger and stabilizer for fixedly mounting the upper end of a tubular well casing concentrically within a conductor to facilitate partially filling of the void between the bore hole and the well casing at its lower end with concrete and which, upon hardening of the concrete, fixes the well casing relative to the conductor, along with the hanger. The hanger comprises a pair of laterally opposed, oppositely oriented, semi-circular, edge abutting metal hanger cylinder halves to form an annular assembly concentrically surrounding the upper end of the well casing. Means are provided for locking the cylinder halves together in edge abutment and in frictional grip with the outer periphery of the casing and in outer peripheral contact with the conductor at its upper end.

Preferably, the outer periphery of the cylinder halves taper downwardly and radially inwardly to assist in axial fixing of the upper end of the well casing relative to the conductor. The inner periphery of the cylinder halves may be serrated, with intersecting, circumferentially spaced longitudinal grooves forming right angle edges which bite into the metal well casing to facilitate frictional gripping of the same. Somewhat larger longitudinal grooves are provided at spaced circumferential positions within the outer periphery. The upper ends of the hanger cylinder halves are slotted adjacent the abutting edges, and the halves are locked together by locking bars which span across the abutting edges, being received within the slots. The bars preferably carry threaded locking screws which are threaded within tapped and threaded holes within the bottom of respective slots. T-bar handles preferable threaded to each of the cylinder halves facilitate insertion of the cylinder halves into the upper end of the conductor pipe and in peripheral contact with the respective, poopsed sides of the well casing receiving the same.

BRIEF DESCRIPTION OF THE DRAWING

FIG. 1 is a vertical sectional view of a well with a conductor in place, and a well casing installed in the bore hole, the well casing carrying at its upper end a well casing hanger, and illustrating the method of fixing the well casing concentric with the conductor by means of a hanger, and stabilizer in accordance with the present invention;

FIG. 2 is an exploded, perspective view of the well casing hanger and stabilizer of FIG. 1, in a preferred form;

FIG. 3 is a top plan view of the well casing hanger of FIGS. 1 and 2, subsequent to joining of the well hanger cylinder halves;

FIG. 4 is a side elevational view of the well casing hanger of FIG. 3;

FIG. 5 is an enlarged, sectional view of a portion of the hanger of FIG. 3 taken about line V—V, illustrating the manner of locking of the cylinder halves together at their confronting vertical edges; and FIG. 6 is a disassembled perspective view of a strengthening collar optionally employed herewith.

DESCRIPTION OF THE PREFERRED EMBODIMENT

The present invention has two aspects. First, the invention is directed to a specific well casing hanger and stabilizer as illustrated generally at 10 in the drawings, and secondly, to the manner of fixedly mounting a well casing concentrically within a conductor through the use of said well casing hanger, as seen in FIG. 1.

A typical environment of employment of the invention is illustrated in FIG. 1. There, the stabilizer or hanger 10 is shown installed in a conductor 57 which has been drawn to a selected depth below the grand level, with a trench or cellar 59 thereabout. A bore hole 50 has been drilled within and below the conductor, and a surface casing 58 inserted therein.

With respect to the well casing hanger, the hanger 10, particularly as seen in FIG. 2, comprises a sectional, two part cylindrical or annular assembly comprising mirror image, semi-circular portions which are mechanically locked together in the assembled position and surrounding concentrically a tubular cylindrical metal well casing indicated at 58. The surface casing 58 may be formed of a plurality of end to end joined pipe or well casing sections. The hanger is manufactured in various sizes, corresponding to the outer diameter of the well casing 58 and the inside diameter of the conductor to which the invention has application. The hanger 10 comprises mirror image cylinder halves or sections indicated generally at 12, formed of metal such as steel and being essentially trapezoidal in radial cross-section. They include an upper end wall 14, a lower end wall 16, a radially outer wall or outer periphery 18, and a radially inner wall or inner periphery 20. The hanger is formed in segmental form and each half terminates in vertical edges or faces 22, which abut the faces or edges of the mirror image section 12 which is mechanically joined thereto. The hanger concentrically surrounds and frictionally grips the outer periphery of the well casing 58 as a complete cylindrical assembly. In order to prevent the well casing 58 from moving vertically upwardly within its conductor 57, it is necessary that the well casing hanger bite into the periphery of the metal well casing. In that respect, the major portion of the inner periphery or wall 20 of the hanger section 12 is serrated as at 24, preferably by horizontally threading the surface area between an upper non-threaded or non-serrated band at 26 and a lower non-threaded or non-serrated band 28. Further, at circumferentially spaced positions within the sections or cylinder halves 12, there are provided narrow vertical grooves 30 which further define right angle edges permitting the serrations or threads to bite into the outer periphery of the well casing 58. One of the functions of the well casing hanger is to concentrically position the well casing 58 at its upper end within the conductor 57 and by way of the distribution of concrete as at 60 at its lower end between the outer periphery of the well casing 58 and the periphery of the bore hole 50 at its lower end, maintain the well casing 58 concentric with the conductor and with the bore hole throughout the extent of the length of the latter. The outer periphery 18 of the well casing hanger section or half preferably tapers downwardly and inwardly as may be readily seen in FIG. 2. Further, the outer periphery of the well casing hanger halves are provided with circumferentially spaced grooves 32 which are of rectangular cross-section and which extend from the upper end 14 to the lower end 16 and which also provide right angle edges which bite into the conductor in this case to assist in fixedly locking or lodging the well casing hanger and its frictionally gripped well casing to the wall of the conductor 57 near ground level 54, FIG. 1.

Since the well casing hanger must be annular, that is, completely surround the well casing and define a closed circle, in order to mount it to the well casing 58 at its desired location, the present invention permits the sections 12 to be moved into position from opposite sides of the well casing 58, and to be mechanically locked together adjacent the confronting edges 22. In this respect, upper end walls 14 of section 12 are provided with short length slots 42 extending inwardly from the edges 20 on both sides thereof which act to receive similarly configured and dimensioned locking bars 44. The locking bars 44 are provided with holes adjacent respective ends through which pass the threaded ends **46*a* of locking screws 46. The bottom of slots 42 are provided with tapered and threaded holes as at 48 which threadedly receive the threaded ends 46*a* of the screws 46 to lock the bars within the opposed slots 42 on both sides of respective cylinder halves of sections 12, with the edges 22 of the cylinder halves in abutting position. Since the cylinder halves 12 are relatively massive, the heavy weight of these members and the tapered radially outer walls 18 cause the serrated or threaded portion 24 of the inner periphery of these members to bite into the metal well casing. With the edges in abutment, the locking bars are dropped into place and the locking screws are threaded through respective bar holes and into the holes 48 in the sections to lock the sections together at their upper ends. Further, as the sections 12 drop and seat to the confines of conductor 57, the grooves 32 also shear into the metal of the conductor 57, thus tending to resist any rotative force acting on these members through the well casing 58**.

In order to facilitate transport of the cylinder halves 12, the upper ends 14 of each of these semi-circular annular elements are provided with a further threaded hole as at 34 which receive the threaded end 38 of T-bar handles indicated generally at 36, the handles 36 bearing at their upper end a cross bar 40 which is integral therewith and which permits the sections to be lowered in place or lifted therefrom either manually (if the weight of the sections are capable of being handled in that fashion) or by machinery.

In use, subsequent to installation of the conductor and drilling of the bore hole 50 to the extent desired within earth formation 52 and downwardly from ground level 54, the drilling machinery including the drilling pipe stems (not shown) are removed, at which point the segmented well casing 58 is lowered in place and maintained in position such that its lower end **58*b* is somewhat above the bottom 56 of the bore hole. With the well casing centrally located with respect to the conductor, liquid concrete indicated generally at 60, from a source (not shown), is poured into the upper end 58*a* of the well casing above the hanger 10 and forced under pressure to be discharged from the lower end 58*b* of the well casing, where it rises within the annular space between the outer periphery of the well casing and the periphery of the bore hole 50. The concrete rises to a level indicated at 60*a*, FIG. 1, where it solidifies, locking the lower end of the well casing 58 to the earth formation carrying the bore 50 and in proper concentric position facilitated by the well casing hanger 10**. During this procedure, the casing may be moved up and down in vertical fashion to aid in uniform flow of the concrete.

The use of the well casing hanger insures the concentric location of the well casing relative to the bore hole 50, and casing conductor and insures against forced pressure induced discharge of that casing from the bore hole and permits the fixing of the casing with a reduced amount of concrete mass relative to that required previously, absent the utilization of the well casing hanger.

Thereafter, while the casing is suspended at its upper end 58*a*, the well casing hanger sections 12 are moved into place on each side thereof, such that their vertical edges 22 are opposing. The sections 12 are lowered and forced towards each other and when the edges 22 abut, they are mechanically linked by way of the locking bars which are seated to the slots 42. The cylinder halves or sections 12 are locked together by means of the locking screws 46. The upper end of the well casing 58 is then concentrically positioned with respect to the conductor 57. Further, the tapered outer periphery of the section and now joined well casing hanger in biting into the conductor prevents further movement of this assembly with respect to the conductor. Due to the teeth or serrations over the major surface area 24 of the inner periphery of the hanger and due to the presence of the vertical circumferentially spaced grooves 30 the biting into the metal of the well casing 58, prevents its movement axially out of the bore hole and through the well casing hanger in spite of heavy liquid or gas generated pressured acting on the well casing.

In the event of extreme surface casing lenth requirements, with consequent very heavy weight on the stabilizer, the conductor is strengthened at the location of the stabilizer by clamping a split collar 100 thereabout. The collar comprises collar halves 102 with end flanges 104 receiving cross bolts 106 and is installed as shown in the cellar.

I claim:

1. A well casing hanger and stabilizer for fixedly mounting the upper end of a tubular well casing concentrically within a conductor and in a well bore hole, said hanger and stabilizer comprising:

laterally opposed, oppositely oriented, semi-circular, edge abutting metal hanger cylinder halves forming an annular assembly concentrically surrounding the upper end of said well casing and positioned between said well casing and said bore hole wall, said halves having upper and lower end walls, vertical edges and radially outer and inner walls, slots on the upper walls extending inwardly from said vertical edges and between said radially outer and inner walls, said slots cooperating with means for locking said cylinder halves together in edge abutment with the inner periphery of said cylinder halves in frictional grip with the outer periphery of said casing and with the outer periphery of said cylinder halves lodged within the well bore hole at its upper end, and means for clamping the conductor and hanger together to strengthen the conductor at the location of the hanger.

2. The hanger as claimed in claim 1, wherein the outer periphery of said cylinder halves tapers downwardly and radially inwardly, to facilitiate the axial lodging of said hanger within the conductor with the casing concentric therewith, and a plurality of circumferentially spaced, longitudinal grooves with the outer periphery of said hanger cylinder halves which provide right angle edges which bite into the conductor frictionally engaging the hanger to the conductor.

3. The hanger as claimed in claim 1, wherein the inner peripheries of said cylinder halves are serrated at right angles to their axes and are provided with circumferentially spaced longitudinal grooves forming right angles edges with said serrations to cause said cylinder halves to bite into said metal well casing, said serrations and longitudinal grooves positioned between upper and lower non-serrated bands, and said upper ends of said cylinder halves adjacent the abutting edges bear aligned slots and locking bars spanning said slots and locking screws carried by said locking bars are threaded to respective hanger cylinder halves, and T-bar handles fixedly mounted to the upper ends of said cylinder halves to facilitate insertion of the cylinder halves into the upper end of the bore hole and into said laterally opposed edge abutting position to form said assembly surrounding the upper end of said well casing and removal of the cylinder halves therefrom.

4. A well casing hanger for fixedly mounting the upper end of a tubular well causing concentrically within a tubular conductor axially receiving said tubular well casing, said hanger comprising: laterally opposed, oppositely oriented, semi-circular, edge abutting metal hanger cylinder halves forming an annular assembly concentrically surrounding the upper end of said well casing and positioned between said well casing and said conductor, each of said cylinder halves being of trapezoidal configuration and radial cross-section and having a radially inner surface bearing threads at right angles to their axes and having circumferentially spaced, longitudinal grooves intersecting said threads to define right angle edges to cause said cylinder halves to bite into said tubular well casing when said cylinder halves are in edge abutment, the outer peripheral surfaces of said cylinder halves tapering downwardly and radially inwardly and having circumferentially spaced, longitudinal grooves to facilitate axial lodging of said hanger within said conductor with the casing concentric therewith, aligned slots within the upper ends of said cylinder halves extending inwardly from said abutting edges between said inner and said outer peripheral surfaces, locking bars spanning said slots, locking screws carried by said locking bars and threaded to respective hanger cylinder halves for locking of said cylinder halves together in edge abutment with their inner peripheries of the cylinder halves in frictional grip with the outer periphery of said casing, clamping means comprising collar halves with flanges for clamping said conductor to said hanger, and T-bar handles fixedly mounted to the upper ends of the cylinder halves to facilitate insertion and withdrawal of said hanger into the upper ends of the bore hole.

5. A method of fixedly mounting of a tubular well casing concentrically with a tubular conductor having a conductor wall and a well bore, said method comprising:

inserting said conductor within a bore hole such that the upper end of the conductor projects into a trench below ground level; axially inserting said well casing within said conductor and said hole to the point where the lower end of said casing is spaced slightly from the bottom of said well bore hole;

moving laterally opposed, oppositely oriented, semicircular, edge abuttable metal hanger cylinder halves toward each other from opposite sides of said casing at the point where the casing projects from the upper end of the well bore hole into said trench beneath ground level to form an annular assembly concentrically surrounding the upper end of the well casing and permitting said edge abutting cylinder halves to contact the conductor wall;

locking said cylinder halves together to drive the inner periphery of said cylinder halves into frictional grip with the outer periphery of said casing; and clamping the conductor to the hanger in the area within the trench below ground level so that the conductor is strengthened at the location of the conductor.

* * * * *